US006589703B2

(12) United States Patent
Stelter et al.

(10) Patent No.: US 6,589,703 B2
(45) Date of Patent: Jul. 8, 2003

(54) ELECTROGRAPHIC METHODS USING HARD MAGNETIC CARRIER PARTICLES

(75) Inventors: Eric C. Stelter, Pittsford, NY (US); Robert D. Fields, Rochester, NY (US); Thomas A. Jadwin, Rochester, NY (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/853,412

(22) Filed: May 11, 2001

(65) Prior Publication Data

US 2001/0055723 A1 Dec. 27, 2001

Related U.S. Application Data

(60) Provisional application No. 60/204,942, filed on May 17, 2000.

(51) Int. Cl.[7] ..... G03G 9/08

(52) U.S. Cl. ..... 430/122; 430/111.3; 430/111.31

(58) Field of Search ..... 430/122, 111.3, 430/111.31

(56) References Cited

U.S. PATENT DOCUMENTS

| | | | | |
|---|---|---|---|---|
| 3,716,630 A | | 2/1973 | Shirk | 423/594 |
| 3,795,617 A | | 3/1974 | McCabe | 252/62.1 |
| 3,795,618 A | | 3/1974 | Kasper | 252/62.1 |
| 3,893,935 A | | 7/1975 | Jadwin et al. | 252/62.1 |
| 3,938,992 A | | 2/1976 | Jadwin et al. | 96/1 SD |
| 3,941,898 A | | 3/1976 | Sadamatsu et al. | 427/18 |
| 4,042,518 A | | 8/1977 | Jones | 252/62.6 |
| 4,076,857 A | | 2/1978 | Kasper et al. | 427/18 |
| 4,206,064 A | | 6/1980 | Kiuchi et al. | 430/106 |
| 4,377,332 A | | 3/1983 | Tamura | 355/3 DD |
| 4,385,823 A | | 5/1983 | Kasper et al. | 355/3 R |
| 4,473,029 A | | 9/1984 | Fritz et al. | 118/657 |
| 4,486,091 A | | 12/1984 | Cestari et al. | |
| 4,531,832 A | | 7/1985 | Kroll et al. | 355/3 DD |
| 4,546,060 A | | 10/1985 | Miskinis et al. | |
| 4,623,603 A | | 11/1986 | Iimura et al. | 430/108 |
| 4,623,605 A | | 11/1986 | Kato et al. | 430/110 |
| 4,764,445 A | | 8/1988 | Miskinis et al. | 430/108 |
| 4,833,060 A | | 5/1989 | Nair et al. | 430/137 |
| 4,933,251 A | | 6/1990 | Ichimura | 430/109 |
| 4,982,689 A | | 1/1991 | Honda et al. | 118/656 |
| 5,057,392 A | | 10/1991 | McCabe et al. | 430/109 |
| 5,089,547 A | | 2/1992 | McCabe et al. | 524/262 |
| 5,102,765 A | | 4/1992 | McCabe et al. | 430/110 |
| 5,112,712 A | | 5/1992 | Kasai et al. | 430/95 |
| 5,147,747 A | | 9/1992 | Wilson et al. | 430/109 |
| 5,256,513 A | | 10/1993 | Kawamura et al. | 430/106.6 |
| 5,286,917 A | | 2/1994 | Unno et al. | 118/651 |
| 5,376,492 A | | 12/1994 | Stelter et al. | 430/122 |
| 5,486,420 A | | 1/1996 | Nishihara et al. | 428/405 |
| 5,512,403 A | | 4/1996 | Tyagi et al. | 430/106.6 |
| 5,633,110 A | * | 5/1997 | Desie et al. | 347/55 |
| 5,729,805 A | | 3/1998 | Chiba et al. | 399/276 |
| 5,763,229 A | | 6/1998 | Kobayashi et al. | |
| 5,780,195 A | | 7/1998 | Nava | 430/110 |
| 5,795,692 A | | 8/1998 | Lewis | |
| 5,948,585 A | | 9/1999 | Gady et al. | |
| 5,998,076 A | | 12/1999 | Mahabadi et al. | |
| 6,197,466 B1 | | 3/2001 | Fields et al. | 429/163 |
| 6,200,722 B1 | | 3/2001 | Fields et al. | 430/137 |
| 6,210,851 B1 | * | 4/2001 | Srinivasan et al. | 430/108.2 |

FOREIGN PATENT DOCUMENTS

| | | | |
|---|---|---|---|
| EP | 0 003 905 A1 | 9/1979 | C08J/3/02 |
| EP | 0 086 445 A1 | 8/1983 | H01F/1/36 |
| EP | 0 681 218 A | 11/1995 | |

OTHER PUBLICATIONS

European Search Report dated Sep. 27, 2001, EP 01 11 1234.

"Magnetic Materials", B. D. Cullity, published by Addison–Wesley Pub. Co. 1972, p. 18–23.

"Spray Drying", by K. Masters, published by Leonard Hill Books, London, p. 502–509.

"Ferromagnetic Materials", vol. 3, edited by E. P. Wohlfarth, published by North–Halland Pat. Co. Amsterdam p. 315 et seq.

Research Disclosure No. 21030, vol. 210, Oct. 1981 (published by Industrial Opportunities Ltd., Homewell Havant, Hampshire P09 1EF, United Kingdom).

U.S. Provisional Patent Application Ser. No. 60/204,942 filed May 17, 2000.

U.S. Patent Application Ser. No. 09/853,917 filed May 11, 2001.

* cited by examiner

*Primary Examiner*—Mark A. Chapman
(74) *Attorney, Agent, or Firm*—John L. Wood

(57) ABSTRACT

Disclosed are methods and apparatus for electrographic development which utilize a rotating magnetic core, a toner shell disposed around the rotating magnetic core, and developer compositions disposed on the toner shell which include a hard magnetic material, such as a strontium ferrite. The shell in embodiments has an outer surface with a surface roughness Ra of less than 32 microinches. The methods and apparatus do not require special manufacturing steps to place surface roughness or irregularities on the shell, and, thus, can provide the same or better image quality with relatively less complex manufacturing steps and at reduced cost.

35 Claims, No Drawings

ELECTROGRAPHIC METHODS USING HARD MAGNETIC CARRIER PARTICLES

CROSS REFERENCE TO RELATED APPLICATIONS

This Application claims benefit under 35 USC §119 (e) of prior co-pending U.S. Provisional Patent Application, Serial No. 60/204,942, filed May 17, 2000, the disclosure of which is incorporated herein by reference in its entirety. Attention is also directed to the following related U.S. patent application: U.S. Ser. No. 09/853,917 (Attorney Docket No. 10032) entitled "Electrographic Developer Compositions and Methods" filed concurrently herewith, the disclosure of which is incorporated herein by reference in its entirety.

FIELD OF THE INVENTION

This invention relates to electrography and more particularly it relates to electrographic methods and apparatus using developer compositions comprised of hard magnetic carrier particles for development of electrostatic charge images.

BACKGROUND OF THE INVENTION

In electrography, an electrostatic charge image is formed on a dielectric surface, typically the surface of the photoconductive recording element. Development of this image is typically achieved by moving it into proximity with a developer composition comprising a mixture of pigmented resinous material, known as toner, and magnetically attractable particles, known as carrier. For a two-component developer comprising a mixture of toner particles and carrier particles, the carrier particles serve as sites against which the non-magnetic toner particles can impinge and thereby acquire a triboelectric charge opposite to that of the electrostatic image, when using a charged area development configuration. When the electrostatic image is in proximity with the developer mixture, the toner particles are stripped from the carrier particles to which they had formerly adhered (via triboelectric forces) by the relatively strong electrostatic forces associated with the charge image. In this manner, the toner particles are deposited on the electrostatic image to render it visible. Both contact toning and non-contact toning are known in the art. The present invention can be used with either contact toning or with non-contact toning, and, hereinafter, the term "contact", or its equivalent forms, is used for convenience to describe the developer being in proximity to and in developing relationship with the electrostatic image so that development of the image with toner occurs. Therefore, it should be understood that the scope of the present invention is not limited to contact toning. Discharged area development is also known to the art, and the invention is equally applicable to both charged area development and to discharged area development.

It is generally known to apply developer compositions of the above type to electrostatic images by means of a magnetic applicator comprising a cylindrical sleeve of non-magnetic material having a magnetic core positioned within. The core usually comprises a plurality of parallel magnetic strips which are arranged around the core surface to present alternating north and south oriented magnetic fields. These fields project radially, through the sleeve, and serve to attract the developer composition to the sleeve outer surface to form what is commonly referred to in the art as a "brush" or "nap". Either or both of the cylindrical sleeve and the magnetic core are rotated with respect to each other to cause the developer to advance from a supply sump to a position in proximity to the electrostatic image to be developed. After development, the toner depleted carrier particles are returned to the sump for toner replenishment.

Conventionally, carrier particles made of soft magnetic materials have been employed to carry and deliver the toner particles to the electrostatic image. U.S. Pat. Nos. 4,546,060, 4,473,029 and 5,376,492, the teachings of which are incorporated herein by reference in their entirety, teach the use of hard magnetic materials as carrier particles and also apparatus for the development of electrostatic images utilizing such hard magnetic carrier particles. These patents require that the carrier particles comprise a hard magnetic material exhibiting a coercivity of at least 300 Oersteds when magnetically saturated and an induced magnetic moment of at least 20 EMU/gm when in an applied magnetic field of 1000 Oersteds. The terms "hard" and "soft" when referring to magnetic materials have the generally accepted meaning as indicated on page 18 of Introduction To Magnetic Materials by B. D. Cullity published by Addison-Wesley Publishing Company, 1972.

The hard magnetic carrier materials represent a great advance over the use of soft magnetic carrier materials in that the speed of development is remarkably increased with good image development. Speeds as high as four times the maximum speed utilized in the use of soft magnetic carrier particles have been demonstrated.

In the methods taught by the foregoing patents, a developer comprising carrier particles of a hard magnetic material is moved in the direction of the electrostatic image to be developed by high speed rotation of the multi-pole magnetic core within the sleeve, with the developer being disposed on the outer surface of the sleeve. Rapid pole transitions on the sleeve are mechanically resisted by the carrier because of its high coercivity. Chains of carrier particles comprising the nap of the carrier (with toner particles disposed on the surface of the carrier particles), rapidly "flip" on the sleeve in order to align themselves with the magnetic field reversals imposed by the rotating magnetic core, and as a result, move with the toner on the sleeve through the development zone in actual contact with, or in proximity and developing relationship to, the electrostatic image on a photoconductor. As mentioned previously, this interaction of the developer with the charge image is referred to as "contact" or "contacting" hereinafter for purposes of convenience. Further, the sleeve may also be rotated to increase the velocity of the developer. See also, U.S. Pat. No. 4,531,832, the teachings of which are also incorporated herein in their entirety, for further discussion concerning such a process.

The rapid pole transitions, for example as many as 467 per second at the sleeve surface when the magnetic core is rotated at a speed of 2000 rpm, create a highly energetic and vigorous movement of developer as it moves through the development zone. This vigorous action constantly recirculates the developer to the sleeve surface and then back to the outside of the nap to provide toner for development. This flipping action also results in a continuous feed of fresh toner particles to the image. As described in the above-described patents, this method provides high density, high quality images at relatively high development speeds.

Various materials have been used to treat the surfaces of the toner component of the developer composition to enhance toner performance in an electrographic process. In recent years, polymers with lower melting points, particularly polyester based resins, have been used as a toner resin since they complement the high speed printing equipment and systems recently developed by the printer/copier industry. Also, various other toner addenda, such as low molecular weight polyethylene and polypropylene waxes, have been used to modify the toner resin and improve performance. Incorporating the foregoing materials into the toner can adversely impact the powder flow properties of the developer composition and eventually image quality, and, therefore, the use of silica and/or other metal oxides as a surface treatment for toner to promote flowability has become increasingly important. Also, silica and other metal oxides have been used to reduce adhesion of the toner particles to the dielectric surface bearing the toned electrostatic image, which reduced adhesion can result in better transfer of the toned image to a receiver for the same, such as a paper sheet.

Such uses of surface treated toner are mentioned, for example, in U.S. Pat. No. 5,286,917, which discloses the use of silica in connection with a one-component developer to increase fluidity of the toner. Silica and other surface treatment agents are said to be used for the same or similar reasons in U.S. Pat. Nos. 5,729,805; 4,982,689; and 4,377,332.

A problem associated with the development systems disclosed in the foregoing patents concerns their use of a stationary, i.e., non-rotating, magnetic core and a developer which includes a soft magnetic carrier and surface-treated toner. For example, these patents disclose that the desired low force of adhesion, low coefficient of friction property, associated with the surface treatment also requires a roughened toning applicator, i.e., sleeve, so that the developer can be transported uniformly into close proximity to the photoconductor and develop an image. U.S. Pat. No. 5,729,805 describes, for example, that a particular type of surface roughness must be present, i.e., they teach that surface roughness Ra must be greater than or equal to 0.2 $\mu$m and less than or equal to 5.0 $\mu$m with an average spacing between the surface irregularities of from 10 to 80 $\mu$m. U.S. Pat. No. 4,982,689 also teaches that the surface of a toning applicator or sleeve is roughened in such a manner so as to allow the developer to be uniformly applied regardless of whether the developer composition is a one component, two-component, magnetic, non-magnetic, insulating, or dielectric developer. The patentees in U.S. Pat. No. 4,982,689 disclose a particular manufacturing process for the toning applicator so as to obtain a desired surface roughness on the sleeve.

As mentioned above, the foregoing patents teach that elaborate roughening steps must be used in the manufacture of toning sleeves in order to impart a desired surface roughness which is said to be required for the methods and apparatus disclosed in the patents. Such roughening steps add greatly to the complexity of the manufacturing process for such apparatus, as well as the cost to manufacture the development system.

As can be seen, it would be desirable to develop improved methods for using developer compositions comprised of surface-treated toners in an electrographic process in order to simplify and reduce the cost of electrographic systems, particularly the complexity and costs associated with steps used to manufacture toning systems.

SUMMARY OF THE INVENTION

The foregoing objects and advantages are obtained in one aspect, by a method for development of an electrostatic image utilizing a rotating magnetic core applicator and a developer composition comprised of a hard magnetic material. The method comprises contacting an electrostatic image with at least one magnetic brush comprising:

(a) a rotating magnetic core of a pre-selected magnetic field strength;

(b) an outer nonmagnetic shell disposed about the rotating magnetic core; and (c) an electrographic developer composition disposed on an outer surface of the shell and in contact with the image, the developer composition comprising a mixture of charged toner particles and oppositely charged carrier particles comprised of a hard magnetic material, the toner particles having dispersed on the outer surfaces thereof at least one surface-treatment agent.

In another aspect, the invention relates to a method for developing an electrostatic image comprising contacting the image with at least one magnetic brush comprising:

(a) a rotating magnetic core of a pre-selected magnetic field strength;

(b) an outer nonmagnetic shell having a smooth outer surface thereon with a surface roughness of roughness Ra of less than about 32 microinches; and (c) an electrographic developer composition disposed on the smooth outer surface of the shell and in contact with the image, the developer composition comprising a mixture of charged toner particles and oppositely charged carrier particles comprised of a hard magnetic material, the toner particles having dispersed on the outer surfaces thereof at least one surface-treatment agent.

The present invention is based in part on a finding that the performance of a toning station utilizing at least one magnetic brush comprised of a rotating magnetic core, a toning sleeve, and developer composition comprised of a hard magnetic carrier is relatively insensitive to the surface finish of the toning sleeve. Therefore, no special manufacturing steps to place a special surface finish on the toning shell are required to uniformly apply the developer composition and obtain good image quality.

The invention is described in greater detail hereinafter.

DETAILED DESCRIPTION OF THE INVENTION

The present invention relates to the use of the above-described magnetic brush development system in developing electrostatic images. For example, an embodiment of the invention involves developing an electrostatic image member bearing an electrostatic image pattern by moving the image member through a development zone. A developer composition is also transported through the development zone in developing relation with the charge pattern of the moving imaging member by use of a magnetic brush system comprising an alternating-pole rotating magnetic core of a pre-selected magnetic field strength which is disposed within an outer non-magnetic shell, which shell can also be rotating or stationary. The direction and speed of the core and optionally the shell rotations are controlled such that the developer composition flows through the development zone in a direction co-current with the image member movement. An electrographic dry developer composition is used.

The dry developer composition comprises a toner resin and a hard magnetic carrier. The carrier is preferably a hard magnetic particulate material exhibiting a coercivity of at least about 300 gauss when magnetically saturated and also exhibits an induced magnetic moment of at least about 20 EMU/gm when in an externally applied field of 1,000 gauss. The carrier particles have a sufficient opposite charge and magnetic moment to prevent the carrier particle from transferring to the electrostatic image. The various methods described in U.S. Pat. Nos. 4,473,029 and 4,546,060 can be used in the present invention using the magnetic toner of the present invention in the manners described herein, and these patents are incorporated in their entirety by reference herein.

The electrostatic image so developed can be formed by a number of methods such as by imagewise photodecay of a photoreceptor or imagewise application of a charge pattern on the surface of a dielectric recording element. When photoreceptors are used, such as in high-speed electrophotographic copy devices, the use of half-tone screening to modify an electrostatic image is particularly desirable; the combination of screening with development in accordance with the method of the present invention producing high-quality images exhibiting high Dmax and excellent tonal range. Representative screening methods include those employing photoreceptors with integral half-tone screen, such as those described in U.S. Pat. No. 4,385,823, incorporated in its entirety by reference herein.

Developers in the development system of the present invention are preferably capable of delivering toner to a charged image at high rates and hence are particularly suited to high-volume electrophotographic printing applications and copying applications.

After development, the resulting toned electrostatic image is transferred to a receiver, such as paper, and fixed, i.e., fused thereto, according to known methods.

In more detail, the present invention, in part, relates to a development system. The development system contains a supply of dry developer mixture which includes magnetic toner and hard magnetic carrier particles.

A non-magnetic, cylindrical sleeve, i.e., shell, which can be a stationary shell or a rotating shell, is used for transporting the developer mixture from the supply to the development zone. In embodiments, the sleeve has a smooth surface finish. By "smooth", it is meant a surface roughness Ra of less than 32 microinches or 0.8 microns (which can be attained by conventional grinding methods), and more preferably, less than 12 microinches or 0.3 microns (which may be attained by chrome plating and buffing methods known to the metal fabrication art). Toning shell surfaces with roughness as low as 2 to 6 microinches, or 0.05 to 0.15 microns, such as are obtained by chrome plating and buffing, can also be used. Surface roughness Ra can be determined by profilometry well known to the art.

A magnetic core which includes a plurality of magnetic pole portions is arranged around the core periphery in alternating magnetic polarity relation, which core is disposed within the shell and is rotatable on an axis within the non-magnetic, cylindrical shell. Furthermore, means for rotating the core and optionally the shell are present in order to deliver the developer mixture to the development zone wherein the toner of the developer is transferred to the electrostatic image.

The set up of the development system is preferably a digital printer, such as a Heidelberg DigiMaster™ 9110 printer using a development station comprising a magnetic brush comprising a non-magnetic, cylindrical shell, a magnetic core, and means for rotating the core and optionally the shell as described, for instance, in detail in U.S. Pat. Nos. 4,473,029 and 4,546,060, both incorporated in their entirety herein by reference. The development systems described in these patents can be adapted for use in the present invention. In more detail, the development systems described in these patents preferably use hard magnetic carrier particles. For instance, the hard magnetic carrier particles can exhibit a coercivity of at least about 300 gauss when magnetically saturated and also exhibit an induced magnetic moment of at least about 20 EMU/gm when in an externally applied field of 1,000 gauss.

As previously pointed out in connection with U.S. Pat. Nos. 4,546,060 and 4,473,029, incorporated herein by reference, the patents generally disclose the use of hard magnetic materials as carrier particles. Useful hard magnetic materials include ferrites and gamma ferric oxide. Preferably, the carrier particles are composed of ferrites, which are compounds of magnetic oxides containing iron as a major metallic component. For example, useful compounds include ferric oxide, $Fe_2O_3$, formed with basic metallic oxides such as those having the general formula $MFeO_2$ or $MFe_2O_4$ wherein M represents a mono- or di-valent metal and the iron is in the oxidation state of +3. Preferred ferrites are those containing barium and/or strontium, such as $BaFe_{12}O_{19}$, $SrFe_{12}O_{19}$, and the magnetic ferrites having the formula $MO.6\ Fe_2O_3$, wherein M is barium, strontium, or lead as disclosed in U.S. Pat. No, 3,716,630, the teachings of which are incorporated in their entirety by reference herein.

The preparation of magnetic ferrites generally and hard, hexagonal crystal structure ferrites (Ba, Sr or Pb) in particular, are well documented in the literature. Any suitable method of making the ferrite particles may be employed, such as the methods disclosed in U.S. Pat. Nos. 3,716,630, 4,623,603 and 4,042,518, the teachings of which are incorporated herein by reference in their entirety; European Patent Application No. 0 086 445; "Spray Drying" by K. Masters published by Leonard Hill Books London, pages 502–509 and "Ferromagnetic Materials", Volume 3 edited by E. P. Wohlfarth and published by North-Holland Publishing Company, Amsterdam, N.Y., Oxford, pages 315 et seq, the teachings of which are also incorporated herein by reference. For example, if the ferrite to be prepared is a hard magnetic strontium ferrite, then from about 8 to 12 parts $SrCO_3$ and 85 to 90 parts of $Fe_2O_3$ are mixed with a dispersant polymer, gum arabic, and water as a solvent to form a slurry. The solvent is removed by spray drying the slurry and the resultant green beads are fired at from about 1100° C. to about 1300° C. to form the desired hard magnetic ferrite material described above. The ferrite material is then deagglomerated and/or milled to reduce the particle size to that generally required of carrier particles, that is, less than 100 $\mu$m and preferably from about 3 to 65 $\mu$m, and the resulting carrier particles are then permanently magnetized by subjecting them to an applied magnetic field of sufficient strength to magnetically saturate the particles as described herein.

The coercivity of a magnetic material, as mentioned above, refers to the minimum external magnetic force necessary to reduce the induced magnetic moment from the remanance value to zero while it is held stationary in the external field, and after the material has been magnetically saturated, i.e., the material has been permanently magnetized. A variety of apparatus and methods for the measurement of coercivity of the present carrier particles can be employed. For the present invention, a Lakeshore Model 7300 Vibrating Sample Magnetometer, available from Lakeshore Cryotronics of Westerville, Ohio, is used to measure the coercivity of powder particle samples. The magnetic ferrite powder is mixed with a nonmagnetic polymer powder (90 percent magnetic powder; 10 percent polymer by weight). The mixture is placed in a capillary tube, heated above the melting point of the polymer, and then allowed to cool to room temperature. The filled capillary tube is then placed in the sample holder of the magnetometer and a magnetic hysteresis loop of external field (in Oersteds) versus induced magnetism (in EMU/gm) is plotted. During this measurement, the sample is exposed to an external field of 0 to ±8000 Oersteds.

The carrier particles may be coated to properly charge the toner particles of the developer. This can be done by forming a dry mixture of the ferrite material with a small amount of powdered resin, e.g., from about 0.05 to about 3.0 weight percent resin based on total weight of the ferrite material and resin, and then heating the mixture to fuse the resin. Such a low concentration of resin will form a thin or discontinuous layer of resin on the ferrite particles.

Various resin materials can be employed as a coating on the hard magnetic carrier particles. Examples include those described in U.S. Pat. Nos. 3,795,617; 3,795,618, and 4,076,857, the teachings of which are incorporated herein by reference in their entirety. The choice of resin will depend upon its triboelectric relationship with the intended toner. For use with toners which are desired to be positively charged, preferred resins for the carrier coating include fluorocarbon polymers such as poly(tetrafluoroethylene), poly(vinylidene fluoride) and poly(vinylidene fluoride-co-tetrafluoroethylene) For use with toners which are desired to be negatively charged, preferred resins for the carrier include silicone resins, acrylic resins, as well as mixtures of resins, such as a mixture of poly(vinylidene fluoride) and polymethylmethacrylate. Various polymers suitable for such coatings are also described in U.S. Pat. No. 5,512,403, the teachings of which are incorporated herein by reference in their entirety.

The magnetic carrier particles can be binder-less carriers or composite carriers.

The first of these carriers comprises a binder-free, magnetic particulate hard magnetic ferrite material exhibiting the requisite coercivity and induced magnetic moment as previously described. This type of carrier is preferred.

The second is heterogeneous and comprises a composite of a binder (also referred to as a matrix) and a magnetic material exhibiting the requisite coercivity and induced magnetic moment. The hard magnetic ferrite material as previously described herein is dispersed as discrete smaller particles throughout the binder. However, binders employed as known to those in the art can be highly resistive in nature, such as in the case of a polymeric binder, such as vinyl resins like polystyrene, polyester resins, nylon resins, and polyolefin resins as described in U.S. Pat. No 5,256,513.

The individual bits of the magnetic ferrite material in the binder should preferably be of a relatively uniform size and sufficiently smaller in diameter than the composite carrier particle to be produced. Typically, the average diameter of the magnetic material should be no more than about 20 percent of the average diameter of the carrier particle. Advantageously, a much lower ratio of average diameter of magnetic component to carrier can be used. Excellent results are obtained with magnetic powders of the order of 5 $\mu$m down to 0.05 $\mu$m average diameter. Even finer powders can be used when the degree of subdivision does not produce unwanted modifications in the magnetic properties and the amount and character of the selected binder produce satisfactory strength, together with other desirable mechanical and electrical properties in the resulting carrier particle.

The concentration of the magnetic material in the composite carrier can vary widely. Proportions of finely divided magnetic material, from about 20 percent by weight to about 90 percent by weight, of composite carrier can be used as long as the resistivity of the particles is that representative of the ferrite particles as described above.

The induced moment of composite carriers in a 1000 Oersteds applied field is dependent on the concentration of magnetic material in the particle. It will be appreciated, therefore, that the induced moment of the magnetic material should be sufficiently greater than about 20 EMU/gm to compensate for the effect upon such induced moment from dilution of the magnetic material in the binder. For example, one might find that, for a concentration of about 50 weight percent magnetic material in the composite particles, the 1000 Oersteds induced magnetic moment of the magnetic material should be at least about 40 EMU/gm to achieve the minimum level of 20 EMU/gm for the composite particles.

The binder material used with the finely divided magnetic material is selected to provide the required mechanical and electrical properties. It should (1) adhere well to the magnetic material, (2) facilitate formation of strong, smooth-surfaced particles and (3) preferably possess sufficient difference in triboelectric properties from the toner particles with which it will be used to insure the proper polarity and magnitude of electrostatic charge between the toner and carrier when the two are mixed.

The matrix can be organic, or inorganic, such as a matrix composed of glass, metal, silicone resin or the like. Preferably, an organic material is used such as a natural or synthetic polymeric resin or a mixture of such resins having appropriate mechanical properties. Appropriate monomers (which can be used to prepare resins for this use) include, for example, vinyl monomers such as alkyl acrylates and methacrylates, styrene and substituted styrenes, and basic monomers such as vinyl pyridines. Copolymers prepared with these and other vinyl monomers such as acidic monomers, e.g., acrylic or methacrylic acid, can be used. Such copolymers can advantageously contain small amounts of polyfunctional monomers such as divinylbenzene, glycol dimethacrylate, triallyl citrate and the like. Condensation polymers such as polyesters, polyamides or polycarbonates can also be employed.

Preparation of composite carrier particles according to this invention may involve the application of heat to soften thermoplastic material or to harden thermosetting material; evaporative drying to remove liquid vehicle; the use of pressure, or of heat and pressure, in molding, casting, extruding, or the like and in cutting or shearing to shape the carrier particles; grinding, e.g., in a ball mill to reduce carrier material to appropriate particle size; and sifting operations to classify the particles.

According to one preparation technique, the powdered magnetic material is dispersed in a solution of the binder resin. The solvent may then be evaporated and the resulting solid mass subdivided by grinding and screening to produce carrier particles of appropriate size. According to another technique, emulsion or suspension polymerization is used to produce uniform carrier particles of excellent smoothness and useful life.

The size of the magnetic carrier particles useful in the present invention can vary widely, and preferably have an average particle size of less than 100 microns, and more preferably have an average carrier particle size of from about 5 to about 45 microns as may be determined by a Coulter Counter device well-known in the art.

A preferred developer composition is formed by mixing the carrier particles with toner particles in a suitable concentration. Within developers of the invention, high concentrations of toner can be employed. Accordingly, the present developer preferably contains from about 70 to 99 weight percent carrier and about 30 to 1 weight percent toner based on the total weight of the developer; most preferably, such concentration is from about 75 to 99 weight percent carrier and from about 25 to 1 weight percent toner.

At least one surface-treatment agent is employed for the toner in the developer composition according to the invention, and as mentioned above many such surface treatment agents are known and can be employed in connection with the present invention. Such agents can include silica, which may be surface treated itself to render the silica surface hydrophobic in nature, such as those commercially available from Degussa, like R-972, or from Wacker, like H2000. Preferably, the silica is hydrophobized by surface treatment with dichlorodimethylsilane, silicone oil, or hexamethyldisilazane, and has a particle size (prior to hydrophobizing treatment) of at least about 50 $m^2/g$, and more preferably from about 100 to 410 $m^2/g$. as determined by BET analysis. Other surface-treatment agents include, but are not limited to, other inorganic oxide particulates, such as titania, alumina, zirconia, and other metal oxides; and also polymer beads preferably less than 1 $\mu$m in diameter (more preferably about 0.1 $\mu$m) (where diameter is in terms of volume average diameter), such as acrylic polymers, silicone-based polymers, styrenic polymers, fluoropolymers, copolymers thereof, and mixtures thereof. Mixtures of the foregoing agents are also contemplated.

The amount of the surface treatment agent that can be employed on the toner particles according to the present invention can vary, depending on the particular toner property that is to be modified, but generally the surface treatment agent is used in an amount of from about 0.05 to about 5.0 wt %, based on total weight of the toner employed. More typically, the amount is preferably from about 0.1 to 2 wt %, and more preferably from about 0.15 to about 1.5 wt % based on total weight of the toner.

The foregoing surface treatment agents can be applied to the surfaces of toner particles by conventional surface treatment techniques such as, but not limited to, conventional mixing techniques, such as tumbling the toner particles in the presence of the surface treatment agent. Preferably, the surface treatment agent is distributed on the surface of the toner particles. The surface treatment agent is attracted to the surface of the toner particles and as such can be attached by electrostatic forces or physical means or both. With mixing, preferably uniform mixing is preferred and achieved by such mixers as a high energy Henschel-type mixer sufficient to keep the surface treatment agent from agglomerating or to at least minimize agglomeration. Furthermore, when the surface treatment agent is mixed with the toner particles in order to achieve distribution on the surface of the toner particles, the mixture can be sieved to remove any agglomerated surface treatment agent. Other means to separate agglomerated particles can also be used for purposes of the present invention.

The remaining components of the toner particles, as well as the hard magnetic carrier particles, can be any conventional ingredient. The toner particles can include one or more toner resins that can be optionally colored by one or more colorants by compounding the resin(s) with at least one colorant and any other ingredients. Although coloring is optional, normally a colorant is included and can be any of the materials mentioned in *Colour Index* , Volumes I and II, Second Edition, incorporated herein by reference. Carbon black can be used in toner particles. The amount of colorant can vary over a wide range, for instance, from about 3 to about 20 weight percent of the polymer and combinations of colorants may be used.

The toner resin itself can be selected from a wide variety of materials including both natural and synthetic resins and modified natural resins as disclosed, for example, in U.S. Pat. Nos. 4,076,857; 3,938,992; 3,941,898; 5,057,392; 5,089,547; 5,102,765; 5,112,715; 5,147,747; and 5,780,195, all incorporated herein by reference. Suitable resins include the crosslinked polymers disclosed in U.S. Pat. Nos. 3,938,992 and 3,941,898, particularly crosslinked or non-crosslinked copolymers of styrene or lower alkyl styrenes with acrylic monomers such as alkyl acrylates or methacrylates. Also useful are condensation polymers such as polyesters. Numerous polymers suitable for use as toner resins are disclosed in U.S. Pat. No. 4,833,060, the teachings of which are also incorporated by reference herein.

The toner can also include a charge control agent as known in the art and any conventional charge control agent can be used. Preferably, the charge control agent for negatively charging toners are metal salts of 3,5 ditertbutyl salicylic acid, and for positively charging toners, quaternary ammonium salts, such as TP 415 from Hodogaya. Specific examples include, but are not limited to, Orient Bontron E-84 and Hodogaya T-77 (an organo-iron chelate).

Waxes may also be incorporated into the toner employed in connection with the present invention. Examples of such waxes include, but are not limited to, polyolefin waxes, such as low molecular weight polyethylene, polypropylene, copolymers thereof and mixtures thereof.

The toner is typically prepared by admixing the resin, colorant, and other desired addenda, which admixture can be heated and milled to disperse the colorant and other addenda in the resin. The heated mass is then cooled, crushed into lumps, and finely ground. The resulting toner particles can range in diameter from about 0.5 to about 25 $\mu$m with an average size of from about 1 to about 16 $\mu$m, preferably from about 4 to about 12 $\mu$m. Preferably, the average particle size ratio of carrier to toner particles lies within the range from about 15:1 to about 1:1. However, carrier-to-toner average particle size ratios of as high as 50:1 are useful. The shape of the toner particles obtained by the foregoing method are irregular and varied in size, but the toner can be any shape, regular or irregular, for use in the invention. Spherically shaped particles can be obtained by spray-drying a solution of the toner resin mixture in a solvent. Alternatively, spherical particles can be prepared by the polymer bead swelling techniques, such as those described in European Patent No. 3905 published Sep. 5, 1979, well as by suspension polymerization, such as by the method disclosed in U.S. Pat. No. 4,833,060, also incorporated in its entirety by reference herein.

The invention is further illustrated by the following non-limiting examples.

SPECIFIC EMBODIMENTS OF THE INVENTION

In the following examples, all parts and percentages are by weight and temperatures are in degrees Celsius (°C.), unless otherwise indicated.

EXAMPLE 1 AND COMPARATIVE EXAMPLE A

In this example, a surface-treated toner is prepared and the image quality associated with such toner is compared to the image quality obtained with a conventional (non-surface treated) toner. A toner is initially prepared by the procedure which follows hereinafter. For Example 1, the toner is subjected to a surface treatment with 0.15 wt % of a hydrophobized silica (Wacher HDK 1303) and 0.35 wt % titania (Degussa T805). In Comparative Example A, the same toner is employed except that it has not been surface treated with the silica and titania.

The toner is initially made by mixing 100 parts of a poly(styrene-co-butylacrylate) resin with 7 parts of carbon black (Regal 330 carbon black obtained from Cabot Corporation), together with 1.5 parts of an organo-iron chelate charge control agent (T 77 obtained from Hodagaya Chemical Company of Japan). The foregoing materials are extrusion blended, and then pulverized into a particulate form. The toner is classified to yield a volume median particle size of about 10–12 μm as determined by a Coulter Counter device.

For Example 1, the resulting toner is surface treated by powder blending the pulverized and classified toner particles with the silica and titania surface treatment agents previously described in a high-energy mixer Henschel FM75 mixer obtained from Thyssen Henschel Industrietechnik GmbH of Kassel, Germany. The toner, silica, and titania are added to the mixer in amounts sufficient to yield the above-described weight percentages, and thereafter the mixer is operated at a speed of about 1745 revolutions per minute (rpm) for 2.5 minutes. Subsequently, the resulting toner/silica mixture is collected and sieved with a 230 mesh screen to remove agglomerated silica particles. The resulting sieved surface treated toner is then further employed to prepare developers as described hereinbelow.

The carrier employed is a hard magnetic strontium ferrite particulate material obtained from POWDERTECH of Valpariso, Ind. The carrier as obtained from the manufacturer is coated with a silicone resin.

The developer employed in Example 1 and Comparative Example A is made by blending the above-described toner and carrier in amounts such that the resulting developer consists of 10 wt % toner, based on total weight of the developer composition, with the balance of the developer composition being carrier.

Both toners are used to develop an image with a DigiMaster™ printer having a developer station (available from NexPress Solutions, L.L.C. of Rochester, N.Y.), which employs a rotating magnetic core and shell development system substantially as described hereinabove. The system employs a toning shell with a surface roughness Ra of about 17 microinches, or 0.43 μm, and has a shell speed of 64 revolutions per minute (RPM) and a magnetic core speed 1140 RPM. The toning shell is 2 inches in diameter, and the rotating magnetic core has 14 alternating magnetic poles of approximately 1000 gauss, as measured on the toning shell surface.

The following data is obtained and shown in Table I below:

TABLE I

Image Quality Data

| IQ Parameter | Target | Comparative Example A | Example 1 |
|---|---|---|---|
| Dmax, (Dr) | >1.35 | 1.4 | 1.45 |
| Background, RMSG | <1.0 | 0.44 | 0.54 |
| Dmax Mottle | <200 | 194 | 155 |
| Hollow Character | >1.5 | 1.95 | 2.7 |
| Satellites | <1.5 | 1.31 | 2.22 |

The list of "Target" values are specifications related to the DigiMaster™ printer. As can be seen, image density and uniformity is essentially equivalent for the two developer compositions. Although the satellites parameter is somewhat higher than the target value, image formation is comparable for the two toner types, as shown by the $D_{max}$, $D_{max}$ mottle, and hollow character parameters. The data shows that the toning shell employed does not adversely impact image quality.

EXAMPLE 2 AND COMPARATIVE EXAMPLE B

Example 2 and Comparative Example B illustrate the triboelectric charge stability of the developer composition employed in Example 1, with data obtained by use of the developer on a life test device as described hereinafter.

The life test fixture comprises a toning station similar to that disclosed in U.S. Pat. No. 4,473,029, the teachings of which are incorporated herein in their entirety by reference. The toning station has a mixing sump with magnetic toner concentration monitor, feed mechanism (transport roller or bucket brigade plus feed skive), rotating core and shell toning roller, and toner replenishment unit. Toner is taken out continuously by bias development onto a metal drum, from which it is removed by a blade cleaning mechanism. As toner is depleted from the station, a magnetic monitor and control circuitry add replenisher toner such that the toner concentration in the sump is held constant. The rate of takeout is controlled by the bias development voltage. Toner charge per mass (Q/m) is measured off-line (i.e., off of the life test device) by the MECCA method described hereinafter.

The toner Q/m ratio is measured in a MECCA device comprised of two spaced-apart, parallel, electrode plates which can apply both an electrical and magnetic field to the developer samples, thereby causing a separation of the two components of the mixture, i.e., carrier and toner particles, under the combined influence of a magnetic and electric field. A 0.100 g sample of a developer mixture is placed on the bottom metal plate. The sample is then subjected for thirty (30) seconds to a 60 Hz magnetic field and potential of 2000 V across the plates, which causes developer agitation. The toner particles are released from the carrier particles under the combined influence of the magnetic and electric fields and are attracted to and thereby deposit on the upper electrode plate, while the magnetic carrier particles are held on the lower plate. An electrometer measures the accumulated charge of the toner on the upper plate. The toner Q/m ratio in terms of microcoulombs per gram (μC/g) is calculated by dividing the accumulated charge by the mass of the deposited toner taken from the upper plate.

The developer compositions employed in Example 1 and Comparative Example A are used in the life test device for a time sufficient to generate the number of equivalent prints as expressed in Table II below. After generating the prints, the toner Q/m ratio is determined by taking a sample of the developer from the life test device and then performing the analysis with the MECCA device as previously described. The data obtained are shown below:

TABLE II

Life Test Data

| Equivalent Prints | Comparative Example B | Example 2 |
|---|---|---|
| 20,000 | −27 μC/g | −29 μC/g |
| 1,000,000 | −11 μC/g | −21 μC/g |

The data in the above table shows that the developer with surface treated toner has a good and stable toner Q/m for the life of the developer composition as tested in the life test device.

The images obtained from the life test device also are observed to have good hollow character reproduction with a significant reduction in image voids within the characters. Using analysis well known in the art, one can measure the void (white) area within the toned image and percentage of void space within the character. The metric used is—$\log_{10}$ of the percent void space. The present invention can show an improvement with respect to image void space by a factor of about 1 on the logarithmic scale, which in actuality leads to a 10 fold (100%) improvement relative to the conventional, non-surface toner.

EXAMPLE 3

In Example 3, a commercially available rotating magnetic core and toning shell developing station is modified such that the outer surface of the toning shell is polished to a very fine surface finish and then evaluated using a developer comprised of a hard magnetic strontium ferrite carrier for image development performance. The procedure of Example 1 is substantially repeated, except as provided otherwise hereinafter.

The toning shell of the Digimaster™ printer employed in Example 1 is modified so that a band of 5 inches in width in the middle of the shell is polished by conventional methods to a surface roughness Ra of about 6 to 8 microinches, or 0.15 to 0.20 $\mu$m. Otherwise the toning station is substantially the same as described in Example 1.

The developer composition employed is a polyester based toner prepared by mixing mixing 100 parts of a crosslinked bisphenol A polyester resin with 8 parts of carbon black (Regal 330 obtained from Cabot Corporation), together with 2 parts of a salicylate salt charge control agent (Bontron E-84 obtained from Orient Chemical Company), and 2 parts of polyethylene wax (Polywax 200 from Baker Petrolite) and 2 parts polypropylene wax (Viscol 550P obtained from Sanyo of Japan). The foregoing materials are extrusion blended, and then pulverized into a particulate form. The toner is classified to yield a volume median particle size of about 11.5 $\mu$m as determined by a Coulter Counter device. The foregoing toner is then subjected to surface treatment using 0.3 parts of a silane-coated fumed silica (R972 silica obtained from Degussa of Germany) to 100 parts of the above-described toner, by total weight. The surface treatment is done by substantially the same procedure as described in Example 1. The same strontium ferrite hard magnetic carrier as described in Example 1 is also used. The toner and developer are mixed in proportions sufficient to give a toner concentration of 10.6 wt %, based on total weight of the developer composition, and charge to mass ratio is −26 $\mu$C/g as determined by the MECCA method.

Prints are run on the DigiMaster™ printer at a process speed of 110 PPM or 17.5 inches/sec using a shell speed of 130 RPM and a core speed of 1140 RPM in the counter-current direction. A document containing thin lines in the intrack and crosstrack directions and large continuous areas of high density is run. No substantial signs of slippage or image quality problems are observed in the area of the image corresponding to the polished area of the shell, including the absence of any substantial non-uniform densities, "fogging", or background toning. Similarly, no problems are observed with a document containing a 50% tint, 141 line halftone screen alternating with continuous areas of high density. There is no observable difference between the portions of the image corresponding to the polished shell and the portions corresponding to areas of normal roughness.

EXAMPLE 4

The procedure of Example 3 is substantially repeated, except the toning station is operated at a process speed of 180 PPM. The shell and core speeds are increased proportionally from their values at 110 PPM as previously described to yield the desired 180 PPM speed.

As in Example 3, no substantial image quality problems, such as non-uniform density, "fogging" or background toning defects are observed with the documents containing lines, solids, and halftones. There are also no visible differences between portions of the image corresponding to the polished areas of the toning shell and those associated with the standard surface finish of the shell.

EXAMPLE 5

The procedure of Example 3 is substantially repeated, except the toning station is operated at a process speed of 210 PPM. The shell and core speeds are increased proportionally from their values at 110 PPM as previously described to yield the desired 210 PPM speed.

No substantial image quality problems such as non-uniform density, "fogging" or background toning are observed with the documents containing lines, solids, and halftones. There are no visible differences between the portions of the image corresponding to polished areas of the toning shell and those corresponding to the standard finish of the shell. Therefore, the present invention is useful in electrographic processes wherein the process speed (defined as the speed of the imaging surface during development) is at least about 5 inches/sec, with speeds of about 17.5 inches/sec and greater being preferred.

"Electrography" and "electrographic" as used herein are broad terms that include image-forming processes involving the development of an electrostatic charge pattern formed on a surface with or without light exposure, and thus includes electrophotography and other similar processes.

Although the invention has been described in considerable detail, and with particular reference to preferred embodiments, it should be understood that variations and modifications to such embodiments can be made within the scope of the invention.

What is claimed is:

1. A method for development of an electrostatic image comprising contacting the image with at least one magnetic brush comprising:

(a) a rotating magnetic core of a pre-selected magnetic field strength;

(b) an outer nonmagnetic shell disposed about the rotating magnetic core; and (c) an electrographic developer composition disposed on an outer surface of the shell and in contact with the image, the developer composition comprising a mixture of charged toner particles and oppositely charged carrier particles comprised of a hard magnetic material, the toner particles having dispersed on the outer surfaces thereof at least one surface-treatment agent selected from the group consisting of:

beads of a polymer selected from acrylic polymers, styrenic polymers, silicone-based polymers, and fluoropolymers;

hydrophobic silica that has been surface treated with silicone oil or hexamethyldisilazane; and mixtures thereof.

2. The method of claim 1 wherein the surface treatment agent comprises beads of a polymer selected from acrylic polymers, styrenic polymers, silicone-based polymers, and fluoropolymers, further wherein the beads have a volume average diameter of less than about 0.1 $\mu$m.

3. The method of claim 1 wherein the silica has a BET surface area of at least about 50 $m^2/g$ prior to the hydrophobizing surface treatment of the silica.

4. The method of claim 1 wherein the silica has a BET surface area of from about 100 to about 410 $m^2/g$ prior to the hydrophobizing surface treatment of the silica.

5. The method of claim 1 wherein the surface treatment agent is employed in an amount of from about 0.05 to about 5.0 wt % based on total weight of the toner.

6. The method of claim 1 wherein the surface treatment agent is employed in an amount of from about 0.1 to about 2 wt % based on total weight of the toner.

7. The method of claim 1 wherein the surface treatment agent is employed in an amount of from about 0.15 to about 1.5 wt % based on total weight of the toner.

8. The method of claim 1 wherein the toner particles have an average particle size of from about 4 to about 12 $\mu$m.

9. The method of claim 1 wherein the hard magnetic material exhibits a coercivity of at least about 300 gauss when magnetically saturated and has an induced magnetic moment of at least about 20 EMU/gm when in an externally applied field of 1,000 gauss.

10. The method of claim 1 wherein the hard magnetic material is a hard magnetic ferrite.

11. The method of claim 10 wherein the hard magnetic ferrite is selected from strontium ferrite or barium ferrite.

12. The method of claim 10 wherein the hard magnetic material is strontium ferrite.

13. The method of claim 1 wherein the toner comprises a polymer resin selected from polyesters or polystyrene-acrylate copolymers.

14. The method of claim 1 wherein the outer surface of the shell has a surface roughness Ra of less than about 32 microinches.

15. The method of claim 1 wherein the outer surface of the shell has a surface roughness Ra of less than about 12 microinches.

16. The method of claim 1 wherein the method operates at a process speed of about 17.5 inches/sec or greater.

17. A method for development of an electrostatic image comprising contacting the image with at least one magnetic brush comprising:

(a) a rotating magnetic core of a pre-selected magnetic field strength;

(b) an outer nonmagnetic shell having a smooth outer surface thereon with a surface roughness of roughness Ra of less than about 32 microinches; and (c) an electrographic developer composition disposed on the smooth outer surface of the shell and in contact with the image, the developer composition comprising a mixture of charged toner particles and oppositely charged carrier particles comprised of a hard magnetic material, the toner particles having dispersed on the outer surfaces thereof at least one surface-treatment agent.

18. The method of claim 17 wherein the surface treatment agent is selected from silica, titania, alumina, and zirconia.

19. The method of claim 17 wherein the surface treatment agent is silica.

20. The method of claim 17 wherein the surface treatment agent are beads of a polymer selected from acrylic polymers, styrenic polymers, silicone-based polymers, fluoropolymers and mixtures thereof.

21. The method of claim 20 wherein the beads have a volume average diameter of less than about 0.1 $\mu$m.

22. The method of claim 19 wherein the silica is a hydrophobic silica that has been surface treated with dichlorodimethylsilane, silicone oil, or hexamethyldisilazane.

23. The method of claim 22 wherein the silica has a BET surface area of at least about 50 $m^2/g$ prior to the hydrophobizing surface treatment of the silica.

24. The method of claim 22 wherein the silica has a BET surface area of from about 100 to about 410 $m^2/g$ prior to the hydrophobizing surface treatment of the silica.

25. The method of claim 17 wherein the surface treatment agent is employed in an amount of from about 0.05 to about 5.0 wt % based on total weight of the toner.

26. The method of claim 17 wherein the surface treatment agent is employed in an amount of from about 0.1 to about 2 wt % based on total weight of the toner.

27. The method of claim 17 wherein the surface treatment agent is employed in an amount of from about 0.15 to about 1.5 wt % based on total weight of the toner.

28. The method of claim 17 wherein the toner particles have an average particle size of from about 4 to about 12 $\mu$m.

29. The method of claim 17 wherein the hard magnetic material exhibits a coercivity of at least about 300 gauss when magnetically saturated and has an induced magnetic moment of at least about 20 EMU/gm when in an externally applied field of 1,000 gauss.

30. The method of claim 17 wherein the hard magnetic material is a hard magnetic ferrite.

31. The method of claim 30 wherein the hard magnetic ferrite is selected from strontium ferrite or barium ferrite.

32. The method of claim 30 wherein the hard magnetic material is strontium ferrite.

33. The method of claim 17 wherein the toner comprises a polymer resin selected from polyesters or polystyrene-acrylate copolymers.

34. The method of claim 17 wherein the outer surface of the shell has a surface roughness Ra of less than about 12 microinches.

35. The method of claim 17 wherein the method operates at a process speed of about 17.5 inches/sec or greater.

* * * * *